United States Patent [19]

Hand

[11] Patent Number: 5,025,601

[45] Date of Patent: Jun. 25, 1991

[54] POOL WALL SUPPORT

[76] Inventor: Hugh R. Hand, 2310 Lakeshore Road East, Burlington, Ontario, Canada, L7R 1B2

[21] Appl. No.: 260,339

[22] Filed: Oct. 20, 1988

[30] Foreign Application Priority Data

Oct. 22, 1987 [CA] Canada ..... 550011

[51] Int. Cl.[5] ..... E04B 1/35

[52] U.S. Cl. ..... 52/169.7; 4/506

[58] Field of Search ..... 52/169.7, 169.8, 299, 52/724, 725; 4/506

[56] References Cited

U.S. PATENT DOCUMENTS 4,109,324 8/1978 Cornelius ..... 4/506 X 4,232,491 11/1980 Bumgarner, Sr. ..... 52/169.7

*Primary Examiner*—David A. Scherbel

*Attorney, Agent, or Firm*—Rogers & Scott

[57] ABSTRACT

A wall support comprising a substantial upright support member engaging a supporting surface and spaced from a wall, a cross member structurally joining the support member to the wall. The support member is formed of a column of settable material, typically concrete, contained in a complementary hollow element. The support has particular application in the support of panels used to build the walls of inground swimming pools.

4 Claims, 5 Drawing Sheets

POOL WALL SUPPORT

This invention relates to a wall support which has particular application in the support of panels used to build the walls of inground swimming pools.

For the purposes of this description, the invention will be described with particular reference to swimming pool construction, although it will be clear to those skilled in the art that the invention can be used to support many forms of wall in a variety of uses.

Construction of a domestic inground swimming pool is normally commenced by the digging of a hole at a convenient site in a backyard. The hole is formed of a lower part and an upper part. The lower part is of a smaller area and its shape is dictated by the depth and configuration of the pool. A pool floor and a lower pool wall are installed to line the lower part. The upper part surrounds the lower part and the increase in area of the hole at the upper part results in a step in the hole wall between the parts. This invention will be described with reference to the upper wall, which is formed of a plurality of interconnected steel panels. The use of panels allows the upper pool to be formed at the pool site by what is essentially an assembly operation. This reduces the amount of time the pool construction crew has to remain on site and the panels are small enough to be easily transported to the pool site, access to which is often restricted.

The panels sit on a concrete foundation which lies on the step at the top of the lower wall. Lateral support for the panels is provided by a plurality of metal support beams located in the gap between the upper wall and the wall of the upper part of the hole. The beams extend from the concrete foundation, spaced from the panels, to an upper portion of the panels.

The upper edges of the panels may be turned outwards to provide a support surface for a pool surround of, for example, concrete slabs or wood panels. Support for the outer edge of the surround is provided by further metal support beams which extend from the concrete foundation adjacent the lower panel edges to a point level with and spaced from the upper panel edges. The panel and surround support beams may be joined at their mid points to form a single X-shaped support. Clearly, to properly support the pool wall and provide a level pool surround, these members must be emplaced securely and accurately during construction of the pool.

After the pool wall has been fully assembled by connecting the panels to one another and securing them to the respective supports, the gap between the exterior of the pool wall and the wall of the hole is back filled. Accordingly, the exterior of the panels must withstand impacts from fill material as the gap between the panels and the wall of the hole is filled. In some circumstances, the pool is filled with water either during or before filling the gap, so that the water inside the pool will support the panels as they are loaded by the weight of the fill.

When the gap has been filled, the pool surround is attached to the upper edge of the pool wall panels and the upper ends of the pool surround supports. It is necessary to attach the pool surround to the supports because the bearing area provided by each support is limited and simply resting the surround on the beam ends would result in an unstable surround.

When complete, the finished pool wall must accommodate a variety of forces, including those caused by hydrostatic pressure from inside the pool and, particularly when the pool is empty, the weight of fill around the pool. In the event of rain, hydrostatic pressure from ground water surrounding the pool may produce a large, inward force on the pool walls. In addition, wave action results in varying hydrodynamic pressures on the inside of the wall. In winter the frozen ground around the pool expands to exert a lifting force on the pool surround, which can result in distortion or damage to the surround or failure of the connections between the surround and the supports.

It is clear, therefore, that a pool wall must have considerable structural strength and rigidity to withstand these forces and also, to provide a secure mounting for the pipes and other accessories such as pumps or filters which may accompany a pool. An increase in strength could be achieved by the use of thicker steel for the panels and the support members though this would increase the cost of materials and increase transport and assembly costs and difficulties due to the increased weight of the components.

The present invention provides a pool wall support which will exhibit sound structural support for the pool wall while providing a stable and substantial support for the pool surround.

Accordingly, in one of its aspects, the invention provides a pool wall support comprising an upright support member engaging a supporting surface, spaced from and structurally joined to a pool wall.

The invention will be better understood with reference to the drawings, in which.

Figure 1:
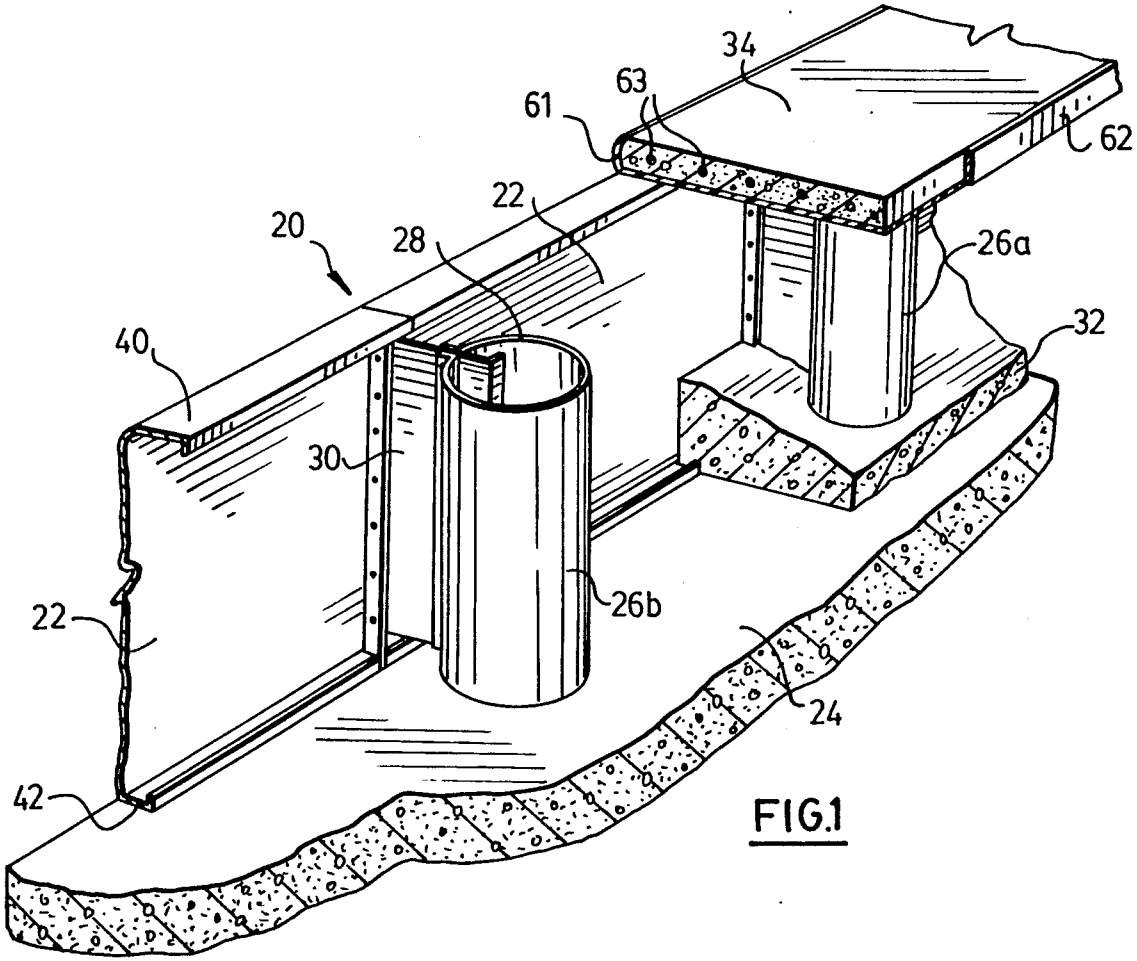
FIG. 1 is a perspective view of a portion of a pool wall showing two wall supports of a preferred embodiment of the invention, one support being shown part complete with a support sleeve empty and the other support being shown complete.

Wall supports of the present invention are herein described in exemplary use, supporting the walls of inground swimming pools of the type described in the foregoing introduction. As seen in FIG. 1 a portion of a partially completed pool wall 20 forming an upper part of the pool. The wall 20 is formed of plurality of interconnected wall panels 22, 23 which rest upon a concrete foundation 24. Lateral support for the wall 20 is provided by wall supports **26*a*, 26*b*** etc. in accordance with the present invention.

FIG. 1 shows two wall supports, one shown complete as **26*a*, and the other shown partially complete as 26*b*. The wall supports are formed of galvanised steel rolled or bent by hand to form tubular elements 28 and joined to the pool wall 20 by cross members, in the form of galvanised steel webs 30 that extend outwardly from the pool wall 20 into the elements 28 which are subsequently filled with concrete. It has been found that No. 28 gage galvanized steel is suitable for forming the elements 28**.

Additional support is provided by concrete 32 which is poured into the gap left between the pool wall 20 and the wall of the upper part of the excavated hole. The edge of the pool is finished by a deck 34 which rest on the upper ends of the wall panels 22 and the upper ends of the wall supports 26.

Figure 3:
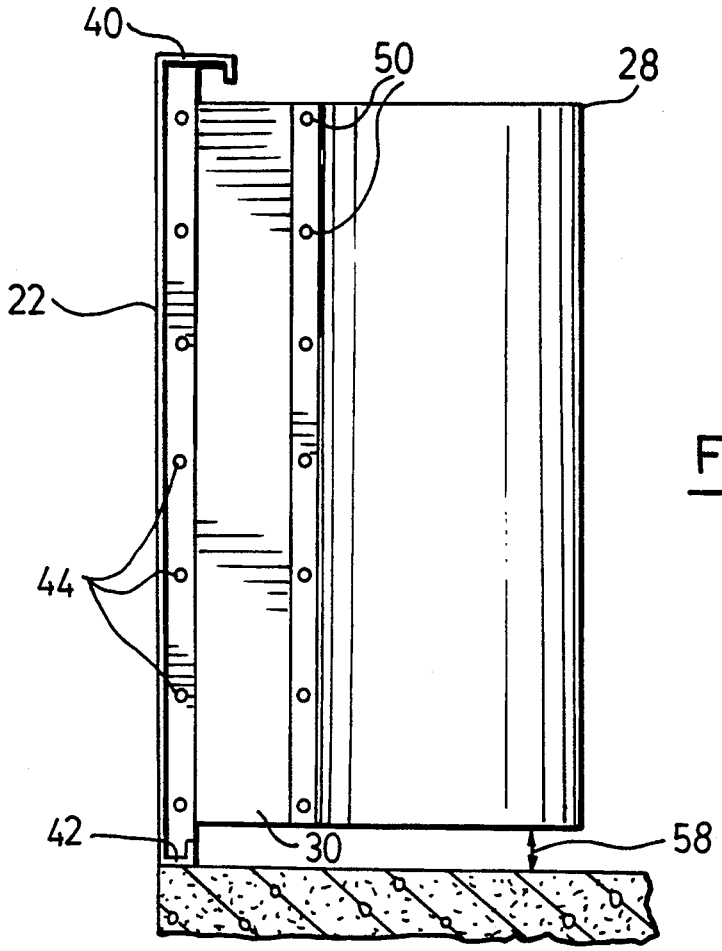
FIG. 3 is a side view of the part complete wall support of FIG. 1.
Figure 2:
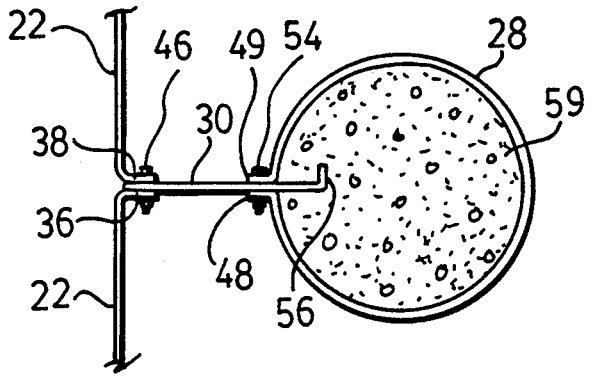
FIG. 2 is a plan view of the part complete wall support of FIG. 1 with the support sleeve filled with concrete.

Reference is next made to FIGS. 1 to 3 to describe the construction of the wall. The panels 22 are of metal sheet and have vertical side flanges 36, 38, a top flange 40 and a bottom flange 42. The side flanges 36, 38 are provided with seven spaced one half inch diameter holes 44 for receiving bolts 46 to connect adjacent panels 22. The bolts 46 also pass through complementary holes in an inner edge of a web 30 which separates the flanges 36, 38.

Each web 30 extends outwardly into a corresponding one of the elements 28 formed from a sheet 45 inches high and rolled into 7 inch diameter cylinder, the vertical ends of the sheet being formed into flanges 48, 49. The web 30 and flanges 48, 49 are each provided with seven complementary one half inch diameter holes 50, for receiving bolts 54. The web 30 is about ten inches wide and has a one inch wide folded stiffening lip 56 which lies inside the element 28. The lip 56 also assists in anchoring the web 30 when the element 28 is filled with concrete.

FIG. 3 illustrates the relative heights of the wall panels 22, web 30 and element 28 and shows that the upper and lower ends of the panels 22 extend beyond the respective ends of the web 30 and tubular element 28. In the example described, the wall panels have a height of 42 inches, and the web and the tube 38 inches. When the wall panels and the pool wall supports are assembled, as shown in FIG. 1, with the lower flange 42 of each wall panel 22 resting on the foundation 24, a gap 58 (FIG. 2) of about 2 inches remains between the bottom end of the element 28 and the bed 24. Thus, when concrete 59 (FIG. 2) is poured into the tubular element 28 and the gap between the excavated hole wall and the external face of the pool wall, there is some linkage between the concrete 59 in the element 28 and the concrete 32 (FIG. 1). After the concrete has set, the pool structure is back-filled to the level of the tops of the supports 26.

The resulting pool wall has the necessary structural strength to withstand the various forces which may act upon the pool wall, and the use of concrete to form the support allows the structure to be built on-site.

Referring again to FIG. 1, a concrete deck 34 is formed to rest on the pool wall and the upper ends of the concrete filled elements 28. The deck 34 is formed by pouring wet concrete into a trough formed by an extruded vinyl coping 61 and a strip of plywood 62 and may be reinforced with steel rods 63. As the elements 28 have a relatively large upper end area the deck is supported thereon without having to use fixing means to ensure that the deck 34 remains stable. Thus, in cold weather when the surrounding ground freezes, the deck 34 is simply lifted from the elements 28 without damage and then on thawing, the deck again sits on the elements 28.

Figure 4:
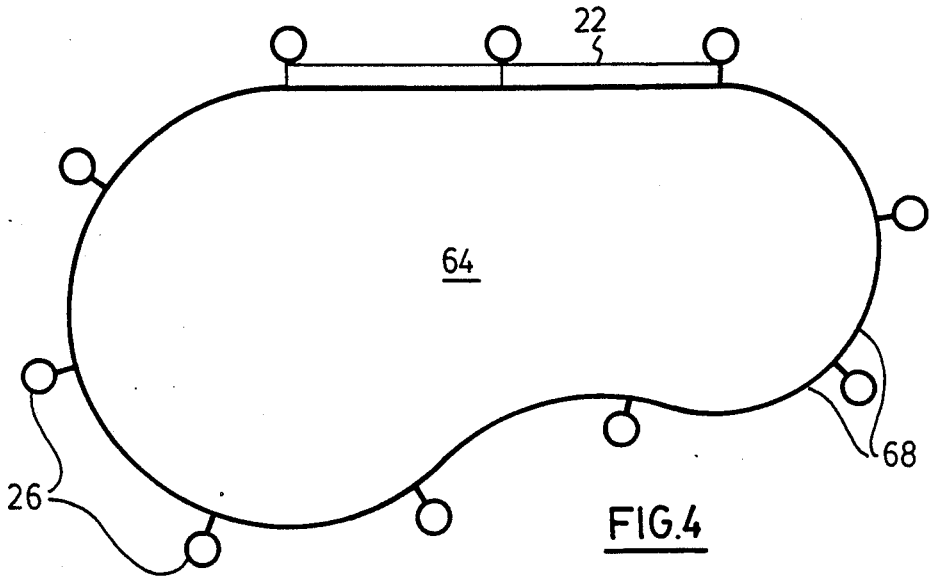
FIGS. 4 and 5 are plan views of exemplary pools utilizing the wall supports of the present invention.
Figure 5:
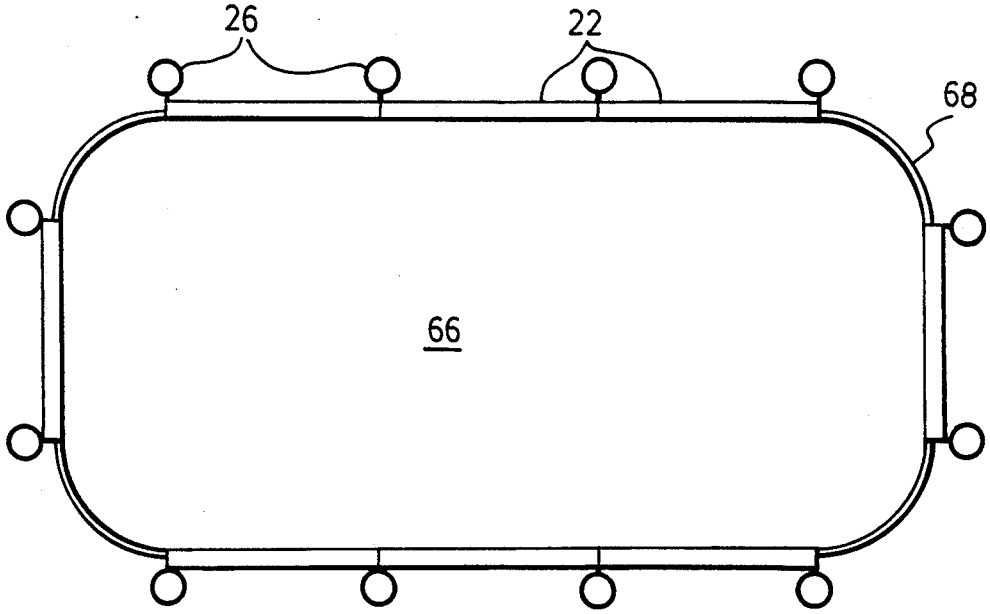

FIGS. 4 and 5 of the drawings show kidney-shaped and rectangular pools 64, 66, respectively, in which planar and curved wall panels 22, 68 have been joined together to form a pool wall supported by the pool wall supports 26.

Various other embodiments of pool wall supports are within the scope of the invention and a number of these are shown in FIGS. 6–10 of the drawings.

Figure 6:
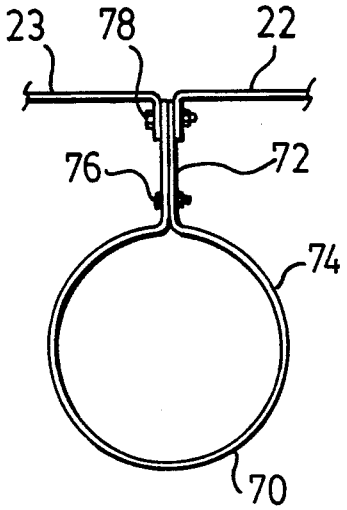
FIGS. 6 to 9 are plan views of further embodiment of wall supports of the present invention.

In FIG. 6, a tubular element 70 and web 72 are formed integrally from a single sheet of steel 74. The sheet 74 is maintained in shape by rows of bolts 76 on a web 72 adjacent a tubular element 70, and by a second row of bolts 78 joining a web 72 to wall panels 22, 23.

Figure 7:
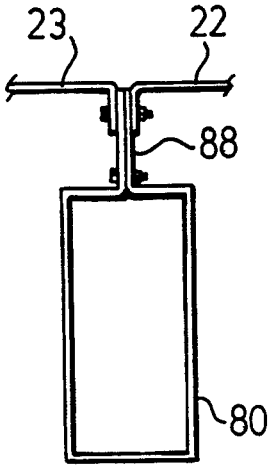
Figure 8:
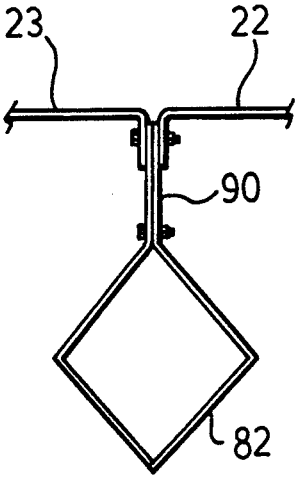

FIGS. 7 and 8 demonstrate that the elements, 80, 82, need not necessarily be tubular. As with the element and web shown in FIG. 6, it is possible that the quadrilateral elements 80, 82 are formed from single sheets, portions of which also form the webs 88, 90. However, rather than shaping a single sheet, it may be desirable to form the elements 80, 82 and webs 88, 90 from a number of planar rectangular sheets which are welded, or otherwise fixed at the edges to form the elements 80, 82 and webs 88, 90.

Figure 9:
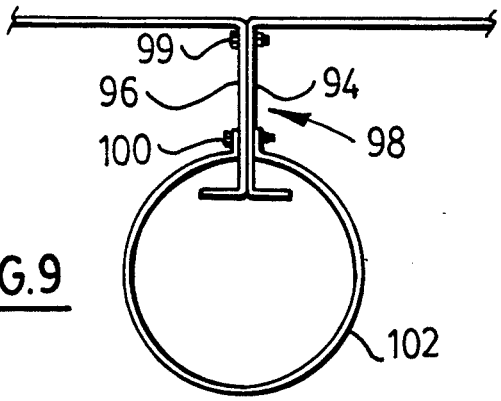

FIG. 9 of the drawings illustrates a further embodiment in which the wall panels have flanges 94, 96 which are lengthened to form a double thickness web 98. The flanges 94, 96 are fixed together with two rows of bolts 99, 100, one of which rows also fixes a tubular element 102 to the web 98.

Figure 10:
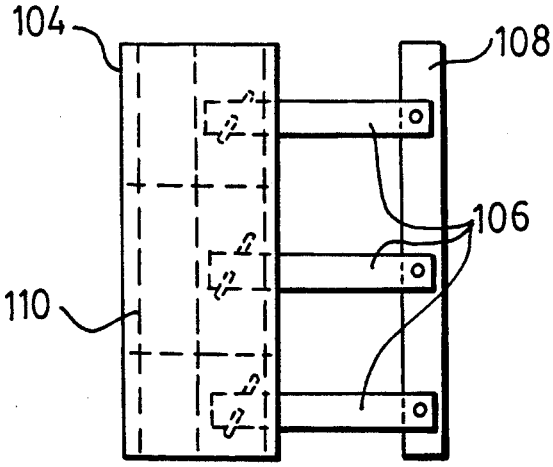
FIG. 10 is a side view of yet another embodiment of the present invention.

The materials used to form the tube and web are not limited to those described in the embodiments. FIG. 10 is an example of the use of an alternative material. In this view a tubular support element is formed of a heavy paper tube 104 of the type used to contain concrete when forming post foundations. This embodiment also illustrates how the web may be replaced by rigid struts 106, fixed to a wall panel 108 and extending through side openings made in the wall of the tube 104. The use of a paper tube 104 and struts 106 will be more cumbersome than the other structures but may be less expensive to produce and easier to transport.

If necessary, additional structural support for the concrete in the tube 104 (or in the other embodiments) can be provided by use of reinforcing elements 110.

It will also be clear to persons familiar with the art that wall supports of the present invention may be used for supporting structures other than the walls of domestic swimming pools and are not limited to use below ground.

I claim:

1. A swimming pool set in the ground essentially below ground level, the pool comprising:

means defining a lower part of the pool and extending downwardly from a peripheral step positioned below ground level and extending endlessly around the lower part;

a wall extending around the pool between the step and ground level, the wall comprising a plurality of panels attached one to another at vertical joints;

a plurality of wall supports extending vertically and supported on the step, each of the wall supports being positioned at one of said joints and including a hollow element extending vertically and filled with concrete, the hollow element being spaced from the pool wall and proportioned to provide a heavy mass of concrete for supporting the pool wall, and a continuous flat web connecting the hollow element to the wall to transmit loads from the wall to the element; and pool edging means supported at least in part by the wall supports.

2. A swimming pool as claimed in claim 1 in which the web is embedded in the concrete contained in the hollow element.

3. A swimming pool as claimed in claim 1 in which the web is attached to the hollow element using fasteners.

4. A swimming pool as claimed in claim 1 in which the hollow element has a cylindrical cross-section.

* * * * *